US012196053B2

(12) United States Patent
Hallundbæk

(10) Patent No.: US 12,196,053 B2
(45) Date of Patent: Jan. 14, 2025

(54) PLUG AND ABANDONMENT SYSTEM

(71) Applicant: Welltec Manufacturing Center Completions ApS, Esbjerg N (DK)

(72) Inventor: Jørgen Hallundbæk, Zug (CH)

(73) Assignee: Welltec Manufacturing Center Completions ApS, Esbjerg N (DK)

( * ) Notice: Subject to any disclaimer, the term of this patent is extended or adjusted under 35 U.S.C. 154(b) by 0 days.

(21) Appl. No.: 17/494,182

(22) Filed: Oct. 5, 2021

(65) Prior Publication Data

US 2022/0106853 A1 Apr. 7, 2022

(30) Foreign Application Priority Data

Oct. 6, 2020 (EP) ..... 20200304

(51) Int. Cl.

| | |
|---|---|
| ***E21B 33/12*** | (2006.01) |
| ***E21B 23/04*** | (2006.01) |
| ***E21B 27/02*** | (2006.01) |
| ***E21B 33/124*** | (2006.01) |
| ***E21B 33/13*** | (2006.01) |

(52) U.S. Cl.

CPC ..... *E21B 33/1208* (2013.01); *E21B 23/0413* (2020.05); *E21B 27/02* (2013.01); *E21B 33/1243* (2013.01); *E21B 33/13* (2013.01)

(58) Field of Classification Search

CPC ..... E21B 33/1208; E21B 23/0413; E21B 33/1243; E21B 33/13; E21B 33/127

See application file for complete search history.

(56) References Cited

U.S. PATENT DOCUMENTS 3,524,503 A * 8/1970 Baker ..... E21B 33/127 166/187
3,918,522 A * 11/1975 Suman, Jr. ..... E21B 3/00 166/187
4,281,678 A * 8/1981 Claycomb ..... E21B 21/08 137/238

(Continued)

FOREIGN PATENT DOCUMENTS

| | | |
|---|---|---|
| CA | 2 814 334 | 6/2012 |
| EP | 2 728 108 | 5/2014 |

(Continued)

OTHER PUBLICATIONS

Extended Search Report for EP20200304, dated Mar. 3, 2021, 8 pages.

*Primary Examiner* — Theodore N Yao
(74) *Attorney, Agent, or Firm* — Nixon & Vanderhye P.C.

(57) ABSTRACT

A plug and abandonment system includes a first annular barrier having a first end and a second end, the first end comprising a first ball seat and the second end being connected with a first disconnectable area, a second annular barrier having a first end and a second end, the first end comprising a second ball seat and being connected with the first disconnectable area, a work string, extending from a first string end to the top of the well, the first string end being disconnectably connected with the second end of the second annular barrier. Each annular barrier has an expandable metal sleeve being connected to at least one tubular part forming a tubular bore for allowing liquid and cement to flow through the annular barriers.

21 Claims, 11 Drawing Sheets

(56) References Cited

U.S. PATENT DOCUMENTS

Figure 1:
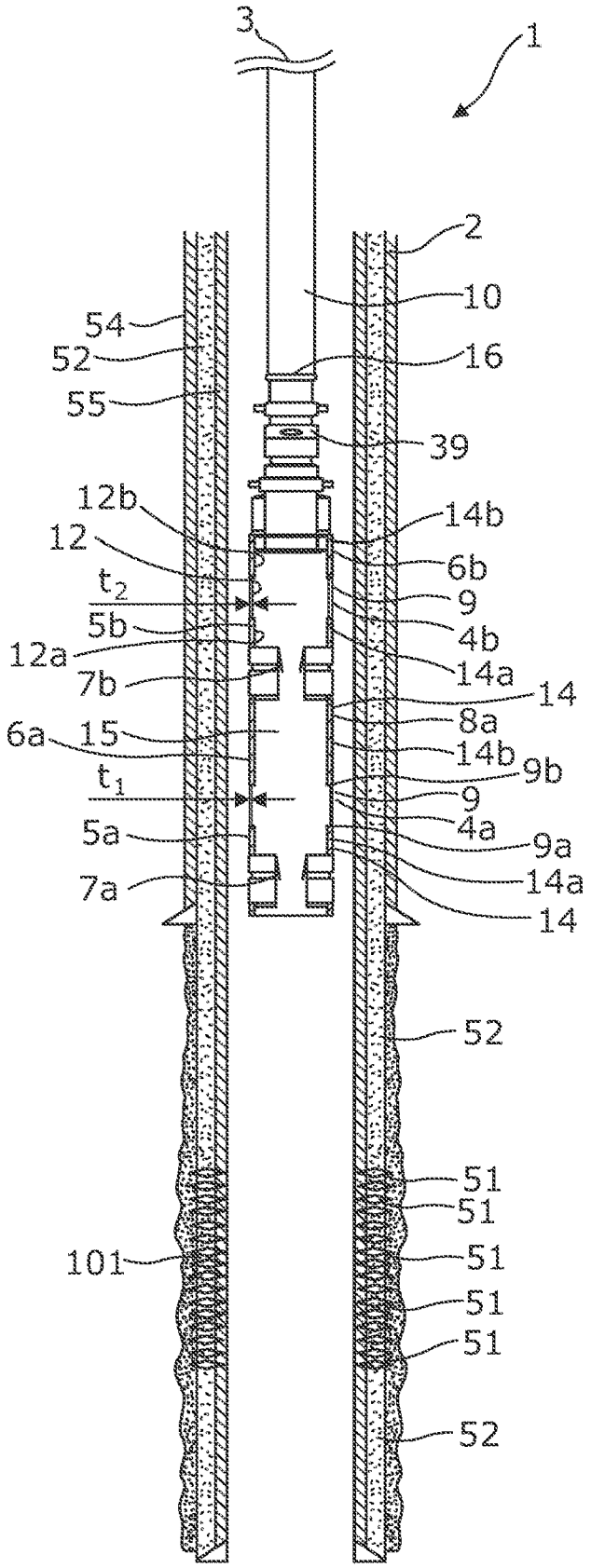

| | | | | |
|---|---|---|---|---|
| 5,404,955 | A * | 4/1995 | Echols, III | E21B 23/06 166/383 |
| 2006/0027371 | A1* | 2/2006 | Gorrara | E21B 33/127 166/387 |
| 2012/0211232 | A1* | 8/2012 | Grodem | E21B 33/1294 166/341 |
| 2012/0261127 | A1* | 10/2012 | Zhou | E21B 21/103 166/118 |
| 2014/0216755 | A1* | 8/2014 | Hallund | E21B 33/1243 166/387 |
| 2015/0300154 | A1* | 10/2015 | Hallundbæk | E21B 47/117 166/250.17 |
| 2016/0108711 | A1* | 4/2016 | Lynk | E21B 43/26 166/308.1 |
| 2017/0016304 | A1* | 1/2017 | Moyes | E21B 33/1204 |
| 2017/0370179 | A1* | 12/2017 | Vasques | E21B 47/06 |
| 2019/0316437 | A1 | 10/2019 | Bårdsen et al. | |

FOREIGN PATENT DOCUMENTS

| | | |
|---|---|---|
| EP | 3 159 478 | 4/2017 |
| EP | 3 263 829 | 1/2018 |
| EP | 3 495 602 | 6/2019 |
| WO | WO 2015/132567 A2 | 9/2015 |

* cited by examiner

PLUG AND ABANDONMENT SYSTEM

This application claims priority to EP patent application No. 20200304.2 filed 6 Oct. 2020, the entire contents of which is hereby incorporated by reference.

The present invention relates to a plug and abandonment system for plugging and abandoning a well having a top. Moreover, the invention also relates to a plug and abandonment method for providing a safe plug and abandonment of a well having at least one production zone.

When a well becomes less productive, and all attempts to improve the production of hydrocarbons from a reservoir have failed, the unproductive part of the well, if not the whole well, is plugged and abandoned. Plug and abandonment is an important part of the lifetime of a well. It is also a costly process, since the authorities have high requirements for the plugging operations in order to ensure that the well does not pollute the environment.

When planning a well, well operators must provide a guarantee covering the costs for plug and abandonment, so that authorities are not left with a large bill to pay for the plug and abandonment of the well, and thus a well operator always seeks a less expensive solution for plug and abandonment so that less money has to be guaranteed.

It is an object of the present invention to wholly or partly overcome the above disadvantages and drawbacks of the prior art. More specifically, it is an object to provide an improved plug and abandonment system which is less complex and costly than known solutions.

The above objects, together with numerous other objects, advantages and features, which will become evident from the below description, are accomplished by a solution in accordance with the present invention by a plug and abandonment system for plugging and abandoning a well having a top, comprising:

- a first annular barrier having a first end and a second end, the first end comprising a first ball seat and the second end 6*a* being connected with a first disconnectable area,
- a second annular barrier having a first end and a second end, the first end comprising a second ball seat and being connected with the first disconnectable area, and
- a work string, such as drill pipe, coiled tubing or a wireline tool with a pump, extending from a first string end to the top of the well, the first string end being disconnectably connected with the second end of the second annular barrier, wherein each of the annular barriers comprises an expandable metal sleeve being connected to at least one tubular part forming a tubular bore for allowing liquid and cement to flow through the annular barriers.

By work string is meant any kind of string capable of performing the plugging and abandoning of a well. The work string may therefore be a string of drill pipe, a string of coiled tubing or a wireline tool string having a pump. Fluid is pumped down from surface through the drill pipe or the coiled tubing, and when using a wireline tool string, the pump in the wireline tool string pumps well fluid into the wireline tool string or from a bailer in the wireline tool string and down the second end of the second annular barrier in the same manner as the drill pipe and the coiled tubing. Thus, one of the functions of the work string is to pump fluid at a certain pressure down the second end of the second annular barrier.

Moreover, by having a first annular barrier disconnectable downhole from a second annular barrier, the plug and abandonment system is less complex and less costly than known solutions as it requires only one run and has a simple design.

Thus, the first disconnectable area is disconnectable downhole so that the first annular barrier and the second annular barrier are disconnectable downhole by turning or pulling or pushing the work string.

In addition, the annular barriers may comprise an expandable metal sleeve, the at least one tubular part forming the tubular bore.

Also, the second ball seat may be connected with the first disconnectable area.

Further, the first annular barrier may be disconnectable from the second annular barrier by means of the first disconnectable area.

Additionally, the cement may be replaced with bismuth, a polymer or a thermite, i.e. a pyrotechnic composition.

Furthermore, each annular barrier may comprise the tubular part and the expandable metal sleeve surrounding the tubular part, each end of the expandable metal sleeve being connected with an outer face of the tubular part providing an expandable space there between.

In addition, the expandable metal sleeve may have a first sleeve end and a second sleeve end being connected with an outer face of the tubular part, the inner face of the tubular part forming the tubular bore.

Moreover, the first annular barrier may comprise a first pressure intensifying unit fluidly connected with tubular bore through an expansion opening in the tubular part in order to intensify the pressure of the fluid flowing in through the expansion opening from the tubular bore before the fluid enters the expandable space.

Further, the pressure-intensifying unit may have a first bore and a piston unit, the first bore having a first bore part with a first inner diameter and a second bore part with a second inner diameter, the piston unit having a first piston with a first outer diameter corresponding to the first inner diameter and a second piston with a second outer diameter corresponding to the second inner diameter, and the second piston being connected to the first piston by means of a connecting rod, which connecting rod has a smaller outer diameter than the second piston, the first outer diameter being smaller than the second outer diameter, the first bore part having a first opening in fluid communication with the expansion opening through a first fluid channel, a first non-return valve being arranged in the first fluid channel allowing fluid to enter the first opening, the first bore having a second opening fluidly connected with a part of the first fluid channel upstream of the first non-return valve, the first bore part having a third opening in fluid communication with an expandable space of the annular barrier between the expandable metal sleeve and the tubular part through a second non-return valve, the second bore part having a fourth opening for entry of fluid in order to allow the first piston to move in a first direction, ejecting fluid through the third opening and into the expandable space, and for exit of fluid in order to allow the first piston to move in a second direction opposite the first direction, and the second bore part having a fifth opening in fluid communication with the fourth opening through a second fluid channel, and a sequence piston surrounding the connecting rod and having a first sequence position in which the sequence piston prevents fluid communication between the second opening and the fifth opening and a second sequence position in which the sequence piston allows fluid communication between the second opening and the fifth opening in order to move the piston unit in the first direction.

Additionally, the tubular part may have a first opening for allowing fluid to flow from the tubular bore to the first annular barrier and a first shear disc arranged in the first opening.

Also, the tubular part may have a second opening for allowing fluid to flow from the tubular bore to the second annular barrier, a second shear disc being arranged in the second opening, the first shear disc being configured to break before the second shear disc.

Furthermore, the first annular barrier may comprise a valve unit fluidly connected with a tubular bore, the valve unit having a piston movable in a bore and prevented from moving by a first shear pin.

Moreover, the valve aperture may be in fluid connection with the expandable space via a fluid channel.

In addition, the plug and abandonment system may further comprise an intermediate annular barrier arranged in between the first annular barrier and the second annular barrier, the first end of the intermediate annular barrier comprising a third ball seat.

Additionally, the second ball seat may be connected with the first disconnectable area via one or more of the intermediate annular barrier(s).

Further, the third ball seat may be connected to the first disconnectable area.

Also, the intermediate annular barrier may comprise a first end and a second end, the second end being connected to another disconnectable area.

Moreover, the second ball seat may be connected to another disconnectable area.

In addition, the second ball seat may be connected to a second disconnectable area.

Additionally, the intermediate annular barrier may be disconnectable from the second annular barrier by means of the other or second disconnectable area.

Further, the third ball seat may have a third inner diameter being larger than a first inner diameter of the first ball seat and being smaller than a second inner diameter of the second ball seat.

Also, the intermediate annular barrier may comprise a second pressure-intensifying unit, the first pressure-intensifying unit being configured to pressure intensify the fluid flowing in the tubular bore with a predetermined pressure-intensifying factor being larger than that of the second pressure-intensifying unit so that the first annular barrier is expanded before the second annular barrier.

Additionally, the intermediate annular barrier may comprise a valve unit having a piston movable in a bore, being prevented from moving by a second shear pin, the first shear pin being configured to shear at a lower force than that of the second shear pin so that the first annular barrier is expanded before the intermediate annular barrier and the second annular barrier.

Furthermore, each of the first and the second annular barrier may comprise the expandable metal sleeve and a first tubular part having a first tubular inner face and a second tubular part having a second tubular inner face, one end of the first tubular part being mounted end-to-end to a first sleeve end of the expandable metal sleeve and one end of the second tubular part being mounted end-to-end to a second sleeve end of the expandable metal sleeve so that the first tubular inner face, the second tubular inner face and the inner sleeve face form the tubular bore.

Moreover, the expandable metal sleeve may have a first sleeve end and a second sleeve end, the first sleeve end being connected with an end of the first tubular part and the second sleeve end being connected with an end of the second tubular part, so that the expandable metal sleeve and the first and second tubular parts form the tubular bore.

Also, the expandable metal sleeve of the first annular barrier may have a first thickness being smaller than a second thickness of the expandable metal sleeve of the second annular barrier, so that the expandable metal sleeve of the first annular barrier is configured to expand at a lower pressure in the tubular bore than the expandable metal sleeve of the second annular barrier.

In addition, the intermediate annular barrier may have a third thickness being smaller than the second thickness of the second annular barrier and larger than the first thickness of the first annular barrier.

Further, the expandable metal sleeve of the first annular barrier may be made of a first material, the expandable metal sleeve of the second annular barrier being made of a second material, the first material demanding lower pressure in order to expand than the second material so that the expandable metal sleeve of the first annular barrier is configured to expand at a lower pressure in the tubular bore than the expandable metal sleeve of the second annular barrier.

Moreover, the intermediate annular barrier may be made of a third material demanding lower pressure in order to expand than the second material but demanding higher pressure than the first material in order to expand so that the expandable metal sleeve of the intermediate annular barrier is configured to expand at a higher pressure in the tubular bore than the expandable metal sleeve of the first annular barrier, and so that the expandable metal sleeve of the intermediate annular barrier is configured to expand at a lower pressure in the tubular bore than the expandable metal sleeve of the second annular barrier.

Furthermore, the plug and abandonment system may further comprise a first ball for seating in the first ball seat.

Additionally, the plug and abandonment system may further comprise a second ball for seating in the second ball seat.

Also, the system may comprise several intermediate annular barriers in between the first annular barrier and the second annular barrier.

Moreover, the first and/or second disconnectable connection may be disconnectable by turning the work string.

Further, the first and/or second disconnectable connection may be disconnectable by breaking a shear pin, e.g. by an axial force along the extension of the work string.

In addition, the first ball seat may have a first inner diameter, the second ball seat having a second inner diameter being larger than that of the first inner diameter.

Furthermore, the plug and abandonment system may further comprise an annular brush connected with the first end of the first annular barrier.

Also, the annular brush may comprise a brush body and surrounding brush arms.

Additionally, the work string may be disconnectably connected with the second annular barrier by means of a running tool.

Further, the well may comprise an outer well tubular metal structure and an inner well tubular metal structure/production casing arranged partly within the outer well tubular metal structure and cement being provided therebetween.

In addition, the inner well tubular metal structure/production casing may have a part extending below the outer well tubular metal structure, that part having perforations.

Moreover, the present invention also relates to a plug and abandonment method for providing a safe plug and abandonment of a well having at least one production zone, comprising:

mounting of a first and second annular barriers to a work string of the plug and abandonment system according to any of the preceding claims, submerging the plug and abandonment system into the well so that the first annular barrier is below the production zone, dropping a first ball into the work string, pumping of fluid down the work string until the first ball seats in the ball seat of the first annular barrier, pressurising the work string and the tubular bore until a first predetermined pressure level, expanding the expandable metal sleeve of the first annular barrier, disconnecting the first disconnectable area in order to disconnect first annular barrier, pulling the work string upwards towards the top of the well, pumping cement down the work string, cementing above the first annular barrier to a level above the production zone, dropping a second ball into the work string, pumping of fluid down the work string until the second ball seats in the ball seat of the second annular barrier, pressurising the work string and the tubular bore until a second predetermined pressure level which is higher than the first predetermined pressure level, expanding the expandable metal sleeve of the second annular barrier, disconnecting the second annular barrier from the work string, pulling the work string upwards towards the top of the well, pumping cement down the work string, cementing above the second annular barrier, and pulling the work string out of the well.

In addition, the plug and abandonment system may further comprise an intermediate annular barrier arranged in between the first annular barrier and the second annular barrier, the first end of the intermediate annular barrier comprising a third ball seat.

Furthermore, mounting of a first and a second annular barrier to a work string may comprise mounting of the intermediate annular barrier in between the first annular barrier and the second annular barrier, so that the second end of the first annular barrier is connected with the first end of the intermediate annular barrier, and the second end of the intermediate annular barrier is connected with the first end of the second annular barrier.

Additionally, before dropping a second ball into the work string, the plug and abandonment method may comprise the following:

dropping a third ball into the work string, pumping of fluid down the work string until the third ball seats in the ball seat of the intermediate annular barrier, pressurising the work string and the tubular bore until a third predetermined pressure level which is higher than the first predetermined pressure level and lower than a second predetermined pressure level, expanding the expandable metal sleeve of the intermediate annular barrier, disconnecting the intermediate annular barrier from the work string, pulling the work string upwards towards the top of the well, pumping cement down the work string, and cementing above the intermediate annular barrier.

Moreover, the present invention also relates to a plug and abandonment method for providing a safe plug and abandonment of a well having at least one production zone, comprising:

mounting of a first and second annular barriers to a work string of the plug and abandonment system according to any of the preceding claims, the work string being a wireline tool having a pump, submerging the plug and abandonment system into the well so that the first annular barrier is below the production zone, dropping a first ball from the wireline tool into the second end of the second annular barrier, pumping of fluid by means of the pump down the second annular barrier until the first ball seats in the ball seat of the first annular barrier, pressurising the tubular bore until a first predetermined pressure level, expanding the expandable metal sleeve of the first annular barrier, disconnecting the first disconnectable area in order to disconnect the first annular barrier, pulling the wireline tool upwards towards the top of the well, pumping cement, bismuth, a polymer or a thermite down the tubular bore, solidifying the cement, bismuth, a polymer or a thermite above the first annular barrier to a level above the production zone, dropping a second ball from the wireline tool, pumping of fluid down the wireline tool until the second ball seats in the ball seat of the second annular barrier, pressurising the second annular barrier until a second predetermined pressure level which is higher than the first predetermined pressure level, expanding the expandable metal sleeve of the second annular barrier, disconnecting the second annular barrier from the wireline tool, pulling the wireline tool upwards towards the top of the well, pumping cement, bismuth, a polymer or a thermite down the tubular bore, solidifying the cement, bismuth, a polymer or a thermite above the second annular barrier, and pulling the wireline tool out of the well.

In addition, after the step of disconnecting the first disconnectable area, pulling the wireline tool upwards towards the top of the well may be continued by pulling the wireline tool out of the well, the bailer section carrying the cement, bismuth, a polymer or a thermite being mounted as part of the wireline tool.

Furthermore, before the step of dropping a second ball, the wireline tool may be pulled out of the well, the bailer section being dismounted from the wireline tool and a tool section entailing the second ball being mounted as part of the wireline tool.

Finally, after the step of disconnecting the second annular barrier from the wireline tool, pulling the wireline tool upwards towards the top of the well may be continued by pulling the wireline tool out of the well, the bailer section carrying the cement, bismuth, a polymer or a thermite being mounted as part of the wireline tool.

Figure 2A:
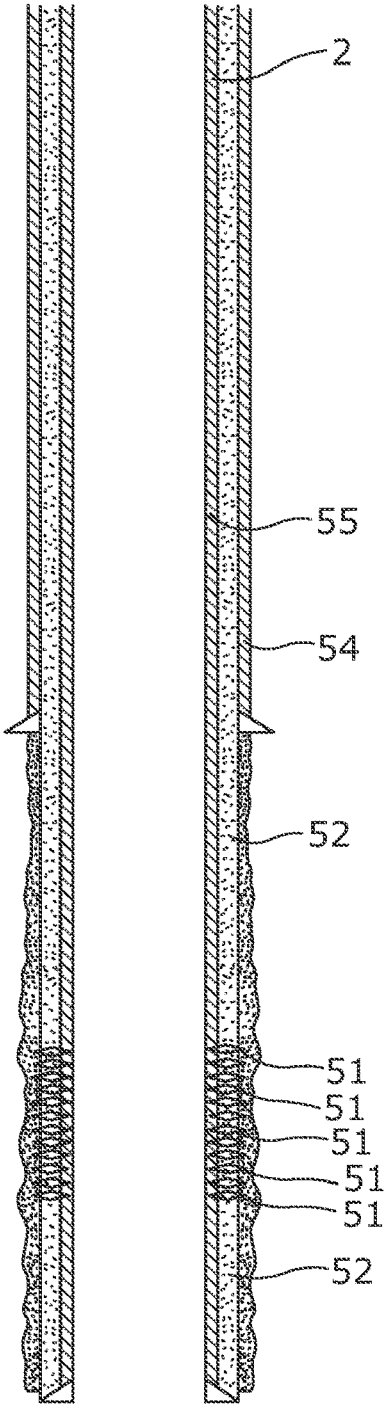
Figure 2B:
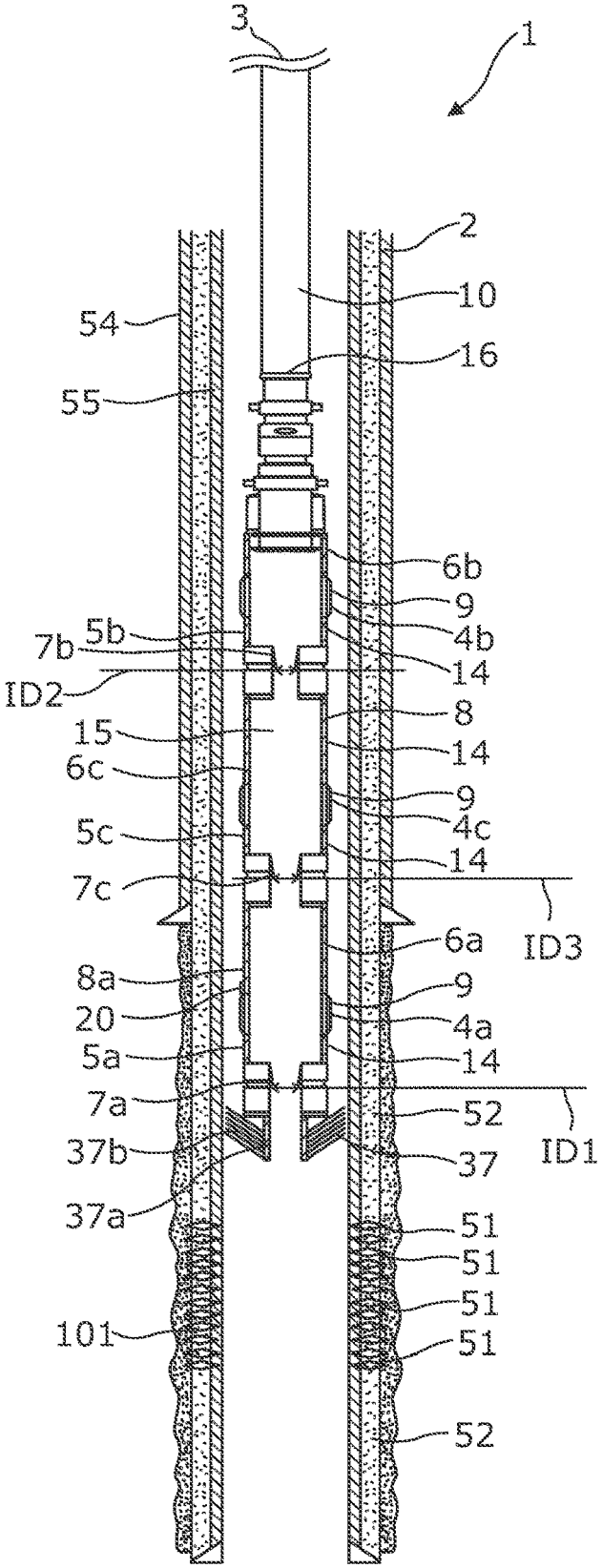
Figure 2C:
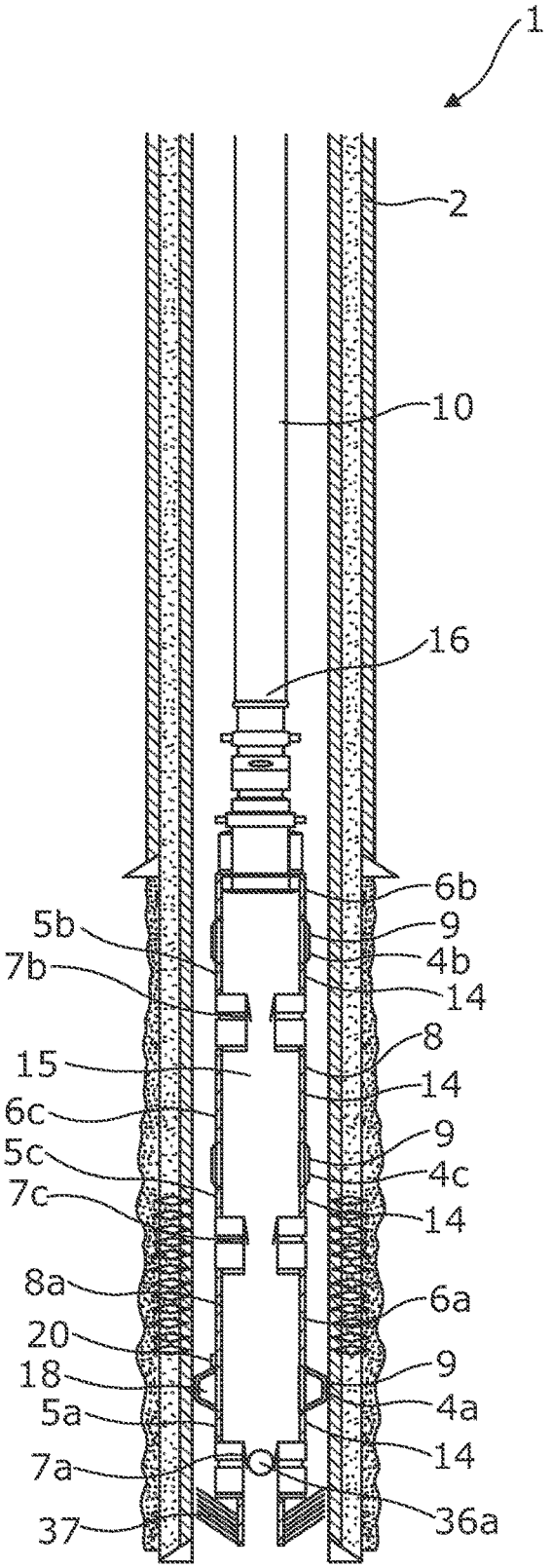
Figure 2D:
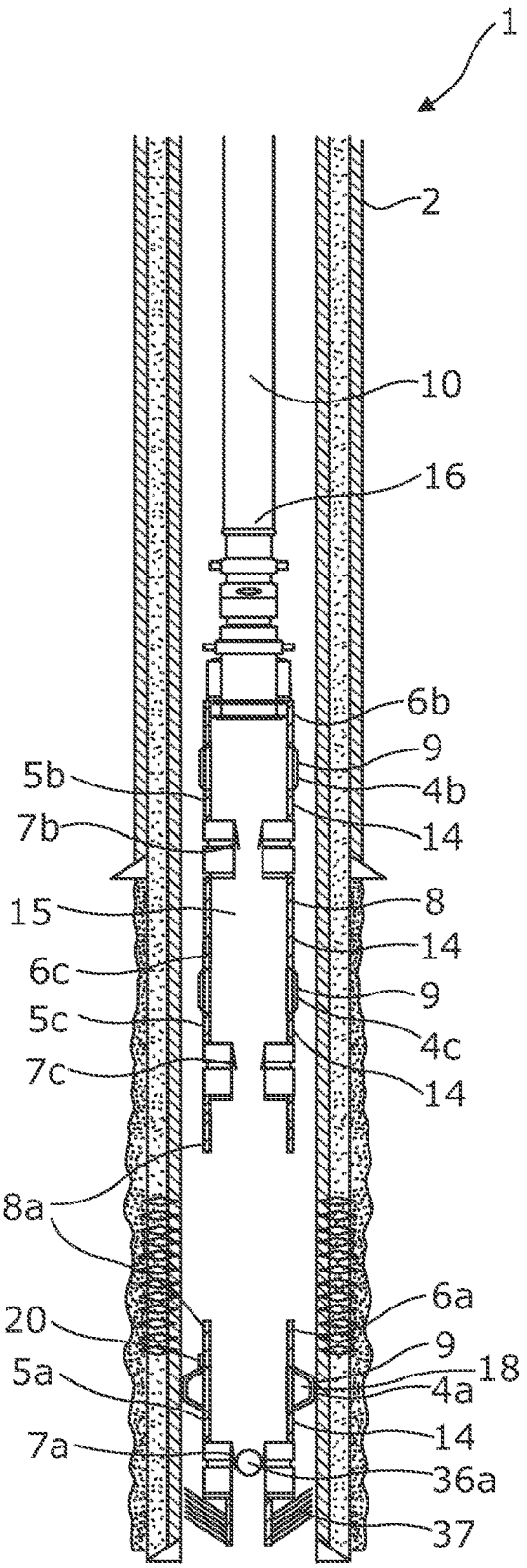
Figure 2E:
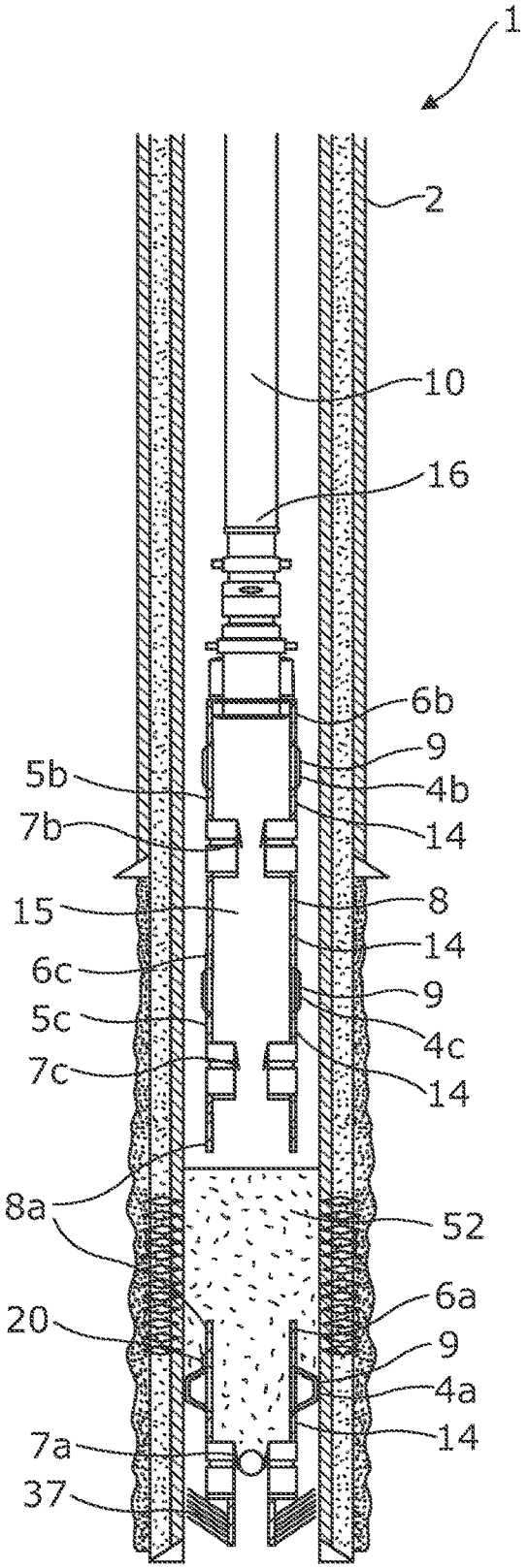
Figure 2F:
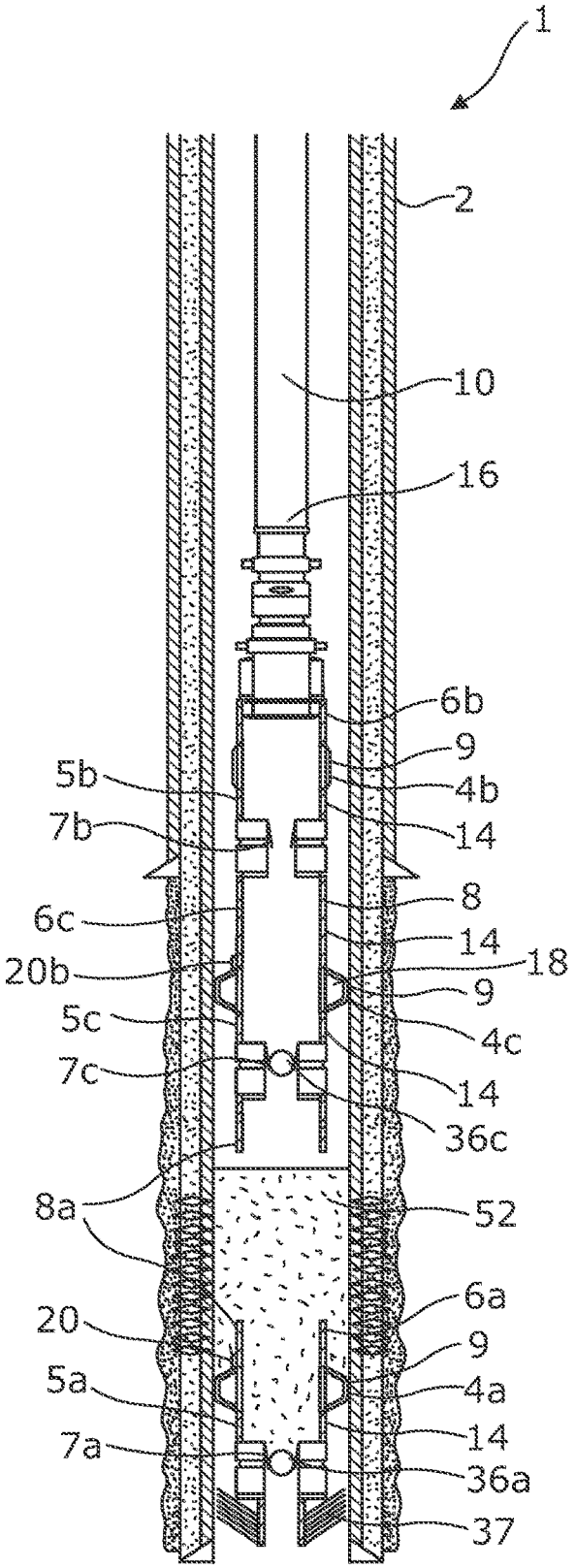
Figure 2G:
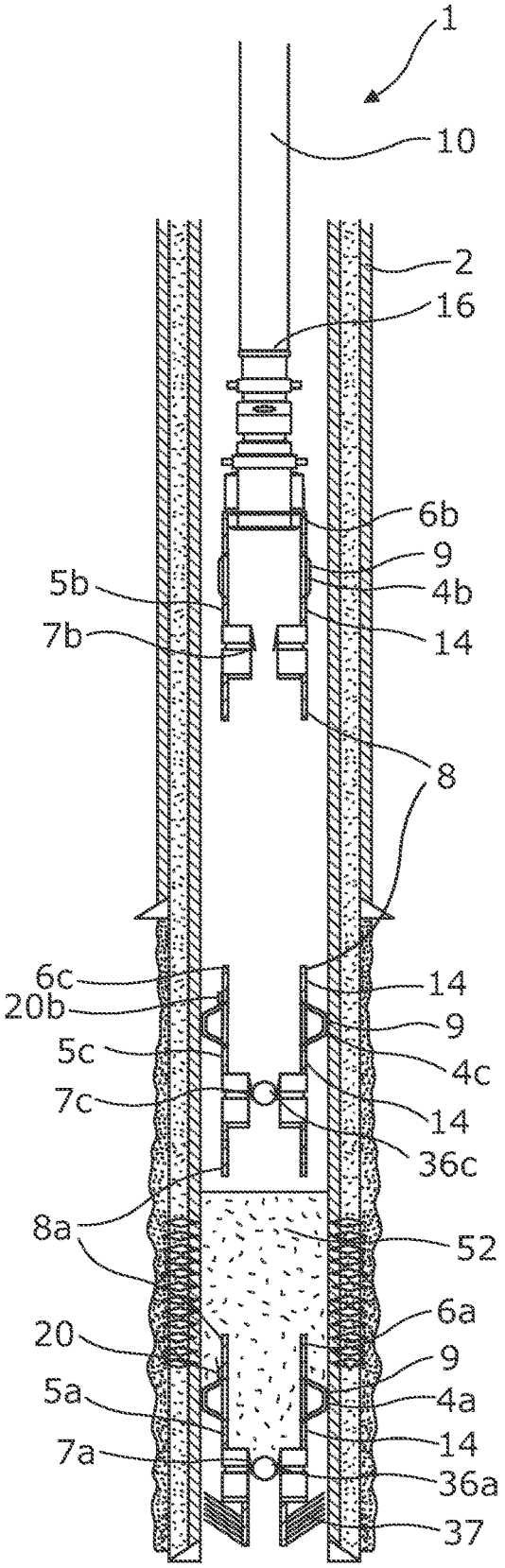
Figure 2H:
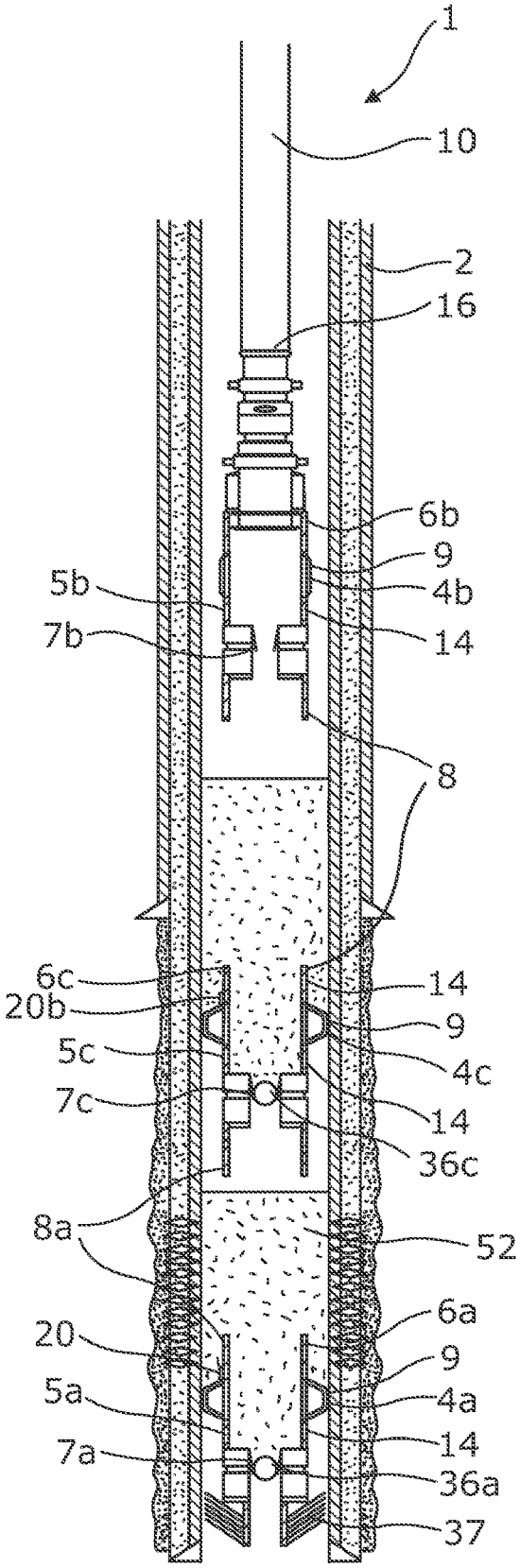
Figure 2I:
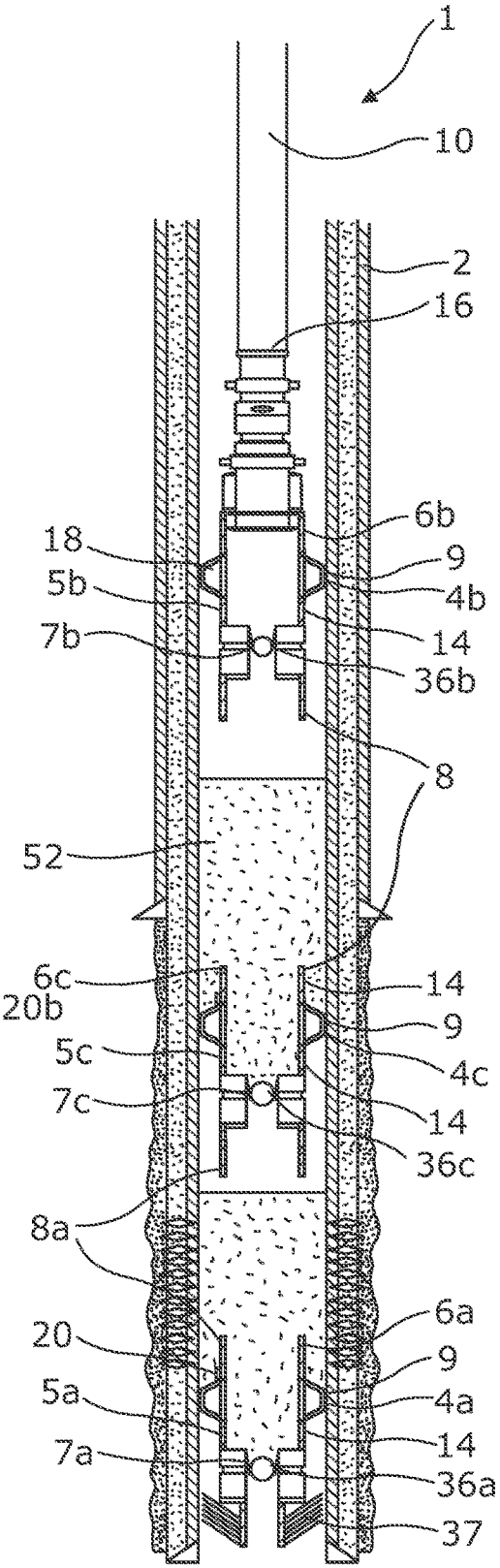
Figure 2J:
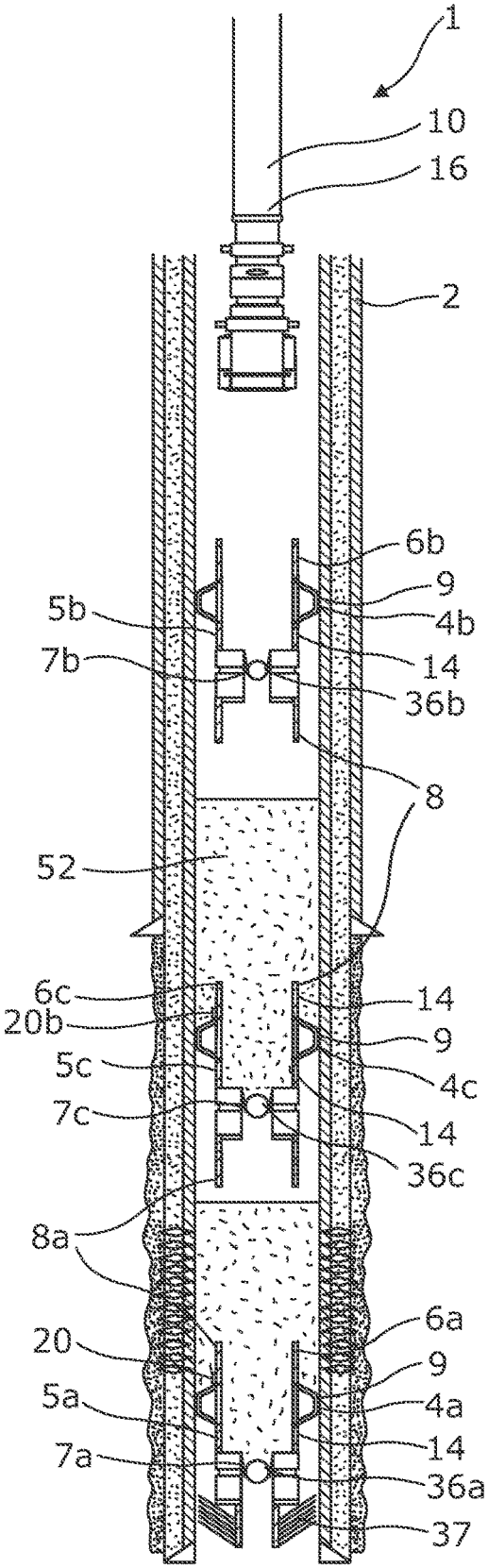
Figure 2K:
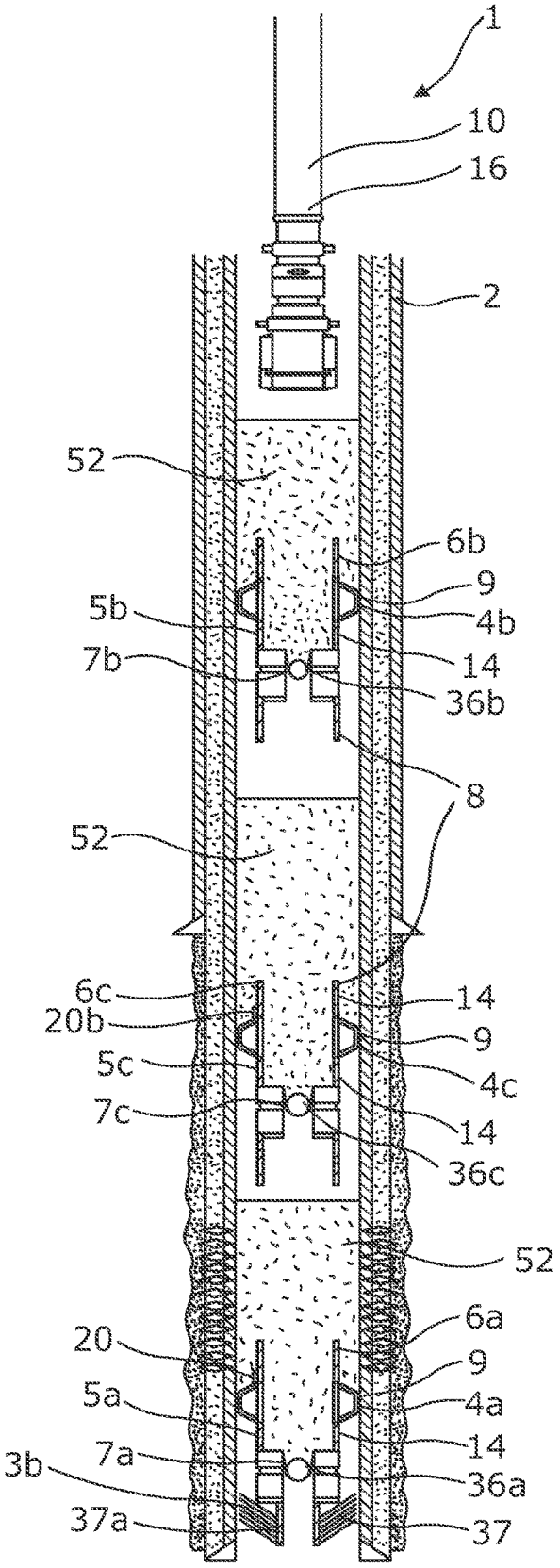
Figure 3:
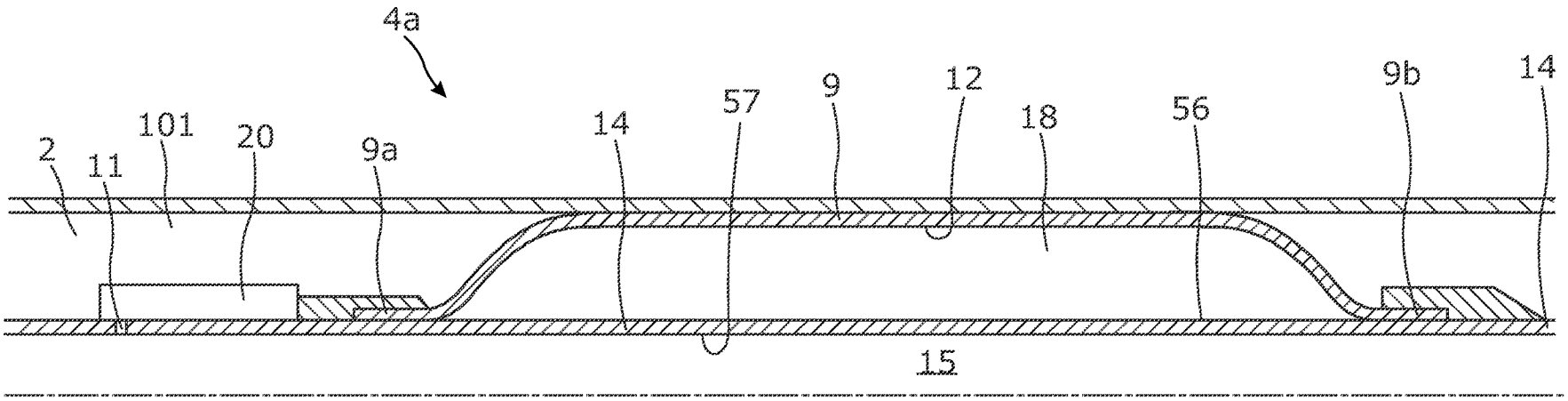
Figure 4:
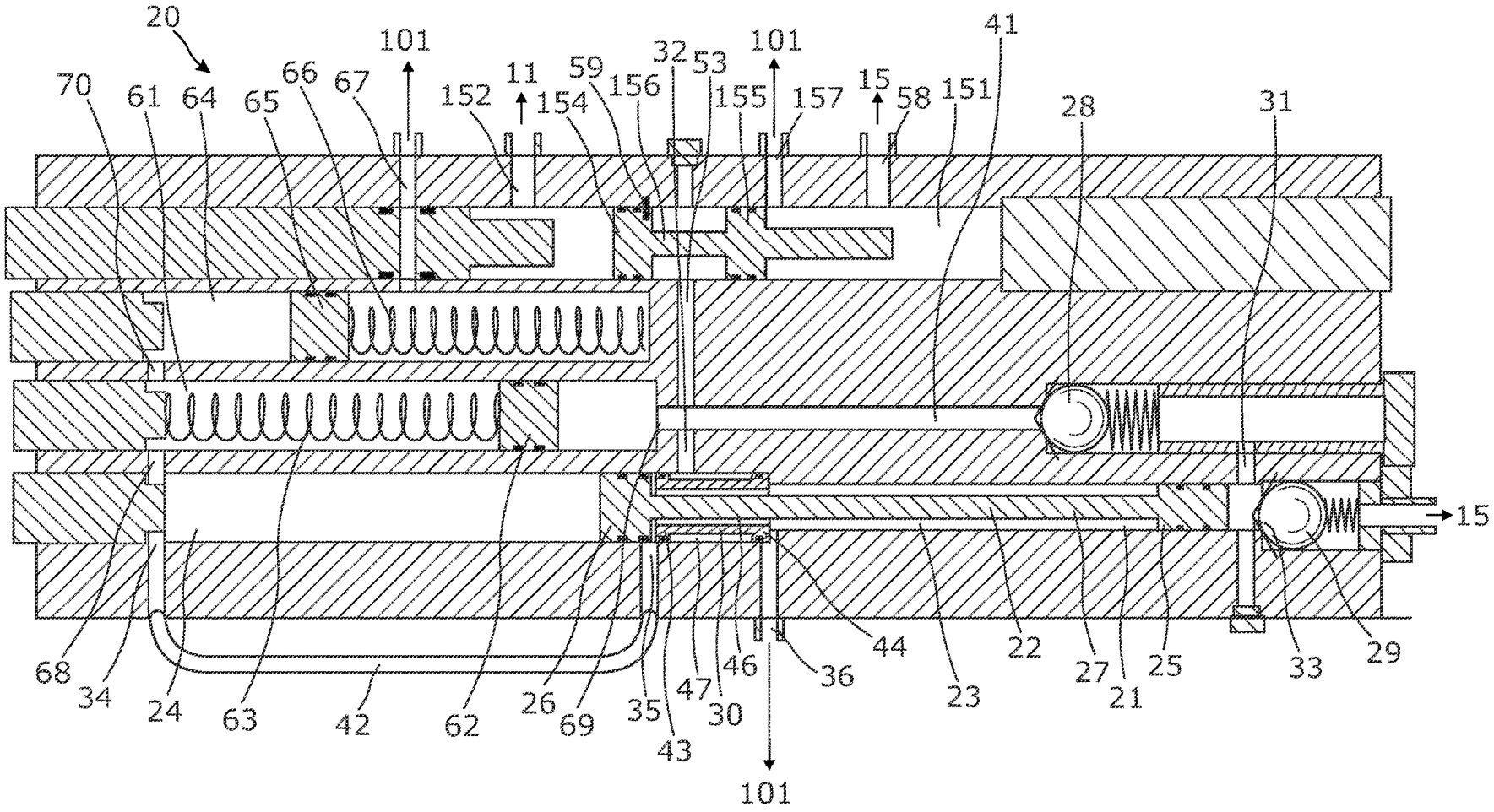
Figure 5:
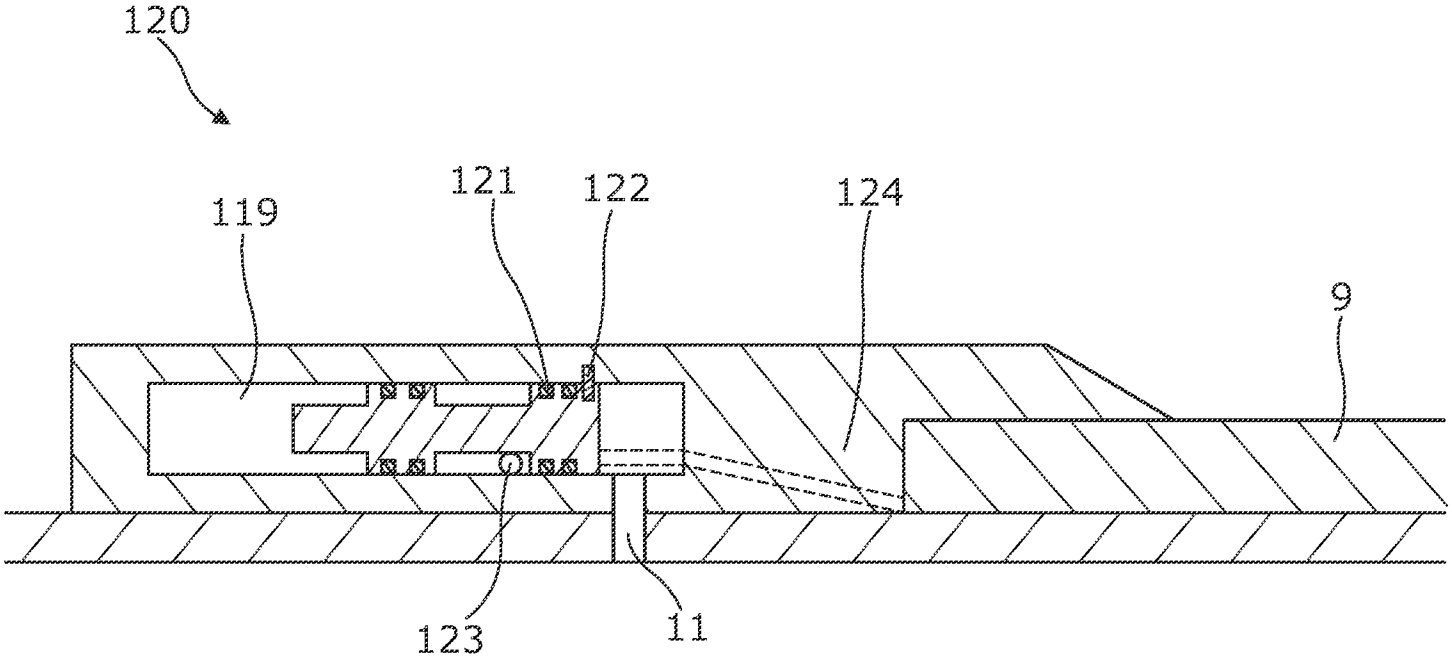
Figure 6:
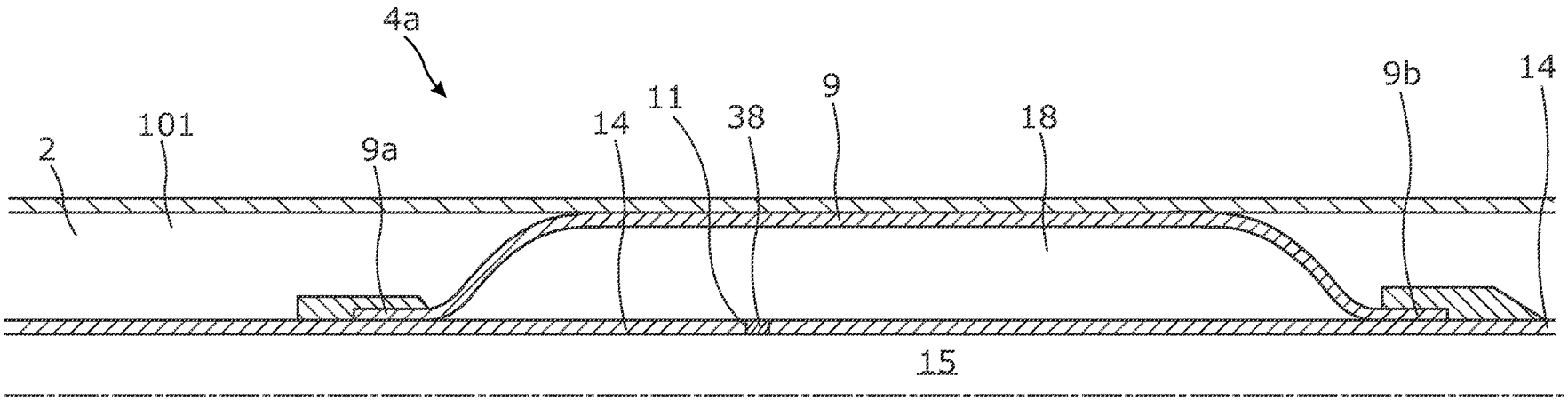

The invention and its many advantages will be described in more detail below with reference to the accompanying schematic drawings, which for the purpose of illustration show some non-limiting embodiments and in which:

FIG. 1 shows a partly cross-sectional view of a plug and abandonment system having two disconnectable annular barriers, FIG. 2A shows a partly cross-sectional view of a well having an inner well tubular metal structure arranged partly within an outer well tubular metal structure and cement there between, FIG. 2B shows a partly cross-sectional view of a plug and abandonment system having three disconnectable annular barriers in their unexpanded condition, FIG. 2C shows a partly cross-sectional view of a plug and abandonment system of FIG. 2B, where the first annular barrier has been expanded, FIG. 2D shows a partly cross-sectional view of a plug and abandonment system of FIG. 2C, where the first annular barrier has been expanded and disconnected from the work string, FIG. 2E shows a partly cross-sectional view of a plug and abandonment system of FIG. 2D, where cement has been pumped down onto the first annular barrier, FIG. 2F shows a partly cross-sectional view of a plug and abandonment system of FIG. 2E, where the intermediate annular barrier has been expanded, FIG. 2G shows a partly cross-sectional view of a plug and abandonment system of FIG. 2F, where the intermediate annular barrier has been expanded and disconnected from the work string, FIG. 2H shows a partly cross-sectional view of a plug and abandonment system of FIG. 2G, where cement has been pumped down onto the intermediate annular barrier, FIG. 2I shows a partly cross-sectional view of a plug and abandonment system of FIG. 2H, where the second annular barrier has been expanded, FIG. 2J shows a partly cross-sectional view of a plug and abandonment system of FIG. 2I, where the second annular barrier has been expanded and disconnected from the work string, FIG. 2K shows a partly cross-sectional view of a plug and abandonment system of FIG. 2J, where cement has been pumped down onto the second annular barrier and the work string is pulled out, FIG. 3 shows a partly cross-sectional view of an annular barrier in its expanded condition, having a pressure-intensifying unit and having an expandable metal sleeve mounted around the tubular part at its end forming an expandable space, FIG. 4 shows a partly cross-sectional view of a pressure-intensifying unit for ensuring that the first annular barrier is expanded before another annular barrier closer to the top of the well, FIG. 5 shows a partly cross-sectional view of a valve unit for controlling that one annular barrier is expanded before another annular barrier, and FIG. 6 shows a partly cross-sectional view of another annular barrier in its expanded condition and having a shear pin in the expansion opening.

All the figures are highly schematic and not necessarily to scale, and they show only those parts which are necessary in order to elucidate the invention, other parts being omitted or merely suggested.

FIG. 1 shows a plug and abandonment system 1 for plugging and abandoning a well 2 having a top 3. The well comprises an inner well tubular metal structure also called a production casing 55 arranged partly within an outer well tubular metal structure 54, cement 52 being provided therebetween and further down the borehole on the outside of the production casing. The production casing 55 has a part extending below the outer well tubular metal structure and having perforations 51 providing a production zone 101.

The plug and abandonment system 1 comprises a first annular barrier 4*a* having a first end 5*a* and a second end 6*a*, the first end 5*a* comprising a first ball seat 7*a* and the second end 6*a* being connected with a first disconnectable area 8*a* in order to be able to disconnect the first annular barrier. The plug and abandonment system 1 further comprises a second annular barrier 4*b* having a first end 5*b* and a second end 6*b*, the first end 5*b* comprising a second ball seat 7*b* and being connected to the first disconnectable area 8*a* which again is connected to the second end 6*a* of the first annular barrier. The plug and abandonment system 1 further comprises a work string 10, such as drill pipe, a wireline tool having a pump or coiled tubing, extending from a first string end 16 to the top of the well. The wireline tool is connected to the top via a wireline. The first string end is disconnectably connected with the second end 6*b* of the second annular barrier 4*b*, e.g. via a running tool or similar equipment. Each of the annular barriers comprises an expandable metal sleeve 9 having an inner sleeve face 12 being connected to at least one tubular part 14, 14*a*, 14*b* forming a tubular bore 15 for allowing liquid and cement to flow through the annular barriers. The cement may be replaced with bismuth, a polymer or a thermite, i.e. a pyrotechnic composition.

Thus, the first annular barrier is disconnectable from the second annular barrier by means of the first disconnectable area by turning or pulling or pushing the work string.

In FIG. 1, each of the first and the second annular barrier 4*a*, 4*b* comprises the expandable metal sleeve 9, a first tubular part 14*a* having a first tubular inner face 12*a* and a second tubular part 14*b* having a second tubular inner face 12*b*. One end of the first tubular part 14*a* is mounted end-to-end to a first sleeve end 9*a* of the expandable metal sleeve, and one end of the second tubular part 14*b* is mounted end-to-end to a second sleeve end 9*b* of the expandable metal sleeve so that the first tubular inner face 12*a*, the second tubular inner face 12*b* and the inner sleeve face 12 form the tubular bore 15. Thus, the annular barriers have no base pipe and no expandable space so that the expandable metal sleeve and the first and second tubular parts form a common tubular bore 15.

In order to be able to expand the lowest and first annular barrier 4*a* before the second annular barrier 4*b*, the expandable metal sleeve 9 of the first annular barrier 4*a* has a first thickness $t_1$ being smaller than a second thickness t2 of the expandable metal sleeve 9 of the second annular barrier 4*b*, so that the expandable metal sleeve 9 of the first annular barrier 4*a* is configured to expand at a lower pressure in the tubular bore 15 than the expandable metal sleeve of the second annular barrier 4*b*.

An alternative way of being be able to expand the lowest and first annular barrier 4*a* before the second annular barrier 4*b* is that the expandable metal sleeve of the first annular barrier shown in FIG. 1 is made of a first material, and the expandable metal sleeve of the second annular barrier has the same thickness as that of the first annular barrier and is made of a second material, where the first material demands lower pressure to expand than the second material so that the expandable metal sleeve of the first annular barrier 4*a* is configured to expand at a lower pressure in the tubular bore 15 than the expandable metal sleeve of the second annular barrier 4*b*.

By being able to expand the lowest annular barrier before the next (second) annular barrier and by being able to disconnect the lowest annular barrier from the next annular barrier, a plug and abandonment system is provided that can be run in one run, i.e. where the work string does not have to be pulled out of the well, and thus the plug and abandonment system provides a safe and quicker way of plugging and abandoning the well. Thus, the plug and abandonment system is less complex and less costly than known solutions, as it requires only one run and has a simple design.

Even though not shown in FIG. 1, the plug and abandonment system 1 may comprise an intermediate annular barrier, and the intermediate annular barrier may have an expandable metal sleeve having a third thickness being smaller than the second thickness of the second annular barrier and being larger than the first thickness of the first annular barrier in order to ensure that the expandable metal sleeve of the first annular barrier is expanded first, the expandable metal sleeve of the intermediate annular barrier is expanded second and the expandable metal sleeve of the second annular barrier is expanded after the expandable metal sleeve of the intermediate annular barrier.

Instead of having different thicknesses as mentioned above, the intermediate annular barrier may be made of a third material demanding lower pressure in order to expand than the second material but demanding higher pressure than the first material in order to expand, so that the expandable metal sleeve 9 of the intermediate annular barrier 4*c* is configured to expand at a higher pressure in the tubular bore 15 than the expandable metal sleeve of the first annular barrier 4*a*, and so that the expandable metal sleeve of the intermediate annular barrier is configured to expand at a lower pressure in the tubular bore than the expandable metal sleeve of the second annular barrier.

As shown in FIG. 3, each annular barrier of the plug and abandonment system comprises only one tubular part 14, and the expandable metal sleeve 9 surrounds the tubular part. Each end 9*a*, 9*b* of the expandable metal sleeve is connected to an outer face 56 of the tubular part 14 providing an expandable space 18 there between. When the expandable metal sleeve having the first sleeve end 9*a* and the second sleeve end 9*b* being connected with the outer face 56 of the tubular part, the inner face 57 of the tubular part forms the tubular bore 15.

FIG. 2A shows a cross-sectional view of a well 2. The well comprises an inner well tubular metal structure also called a production casing 55 arranged partly within an outer well tubular metal structure 54, cement 52 being provided therebetween and further down the borehole on the outside of the production casing. The production casing 55 has a part extending below the outer well tubular metal structure and having perforations 51 providing a production zone 101.

In FIG. 2B, the first annular barrier 4*a* is connected with the second annular barrier 4*b* via an intermediate annular barrier 4*c*. The second ball seat 7*b* is connected with the first disconnectable area 8*a* via one (or more) of the intermediate annular barrier(s). The third ball seat 7*c* of the intermediate annular barrier is connected to the first disconnectable area 8*a*. The intermediate annular barrier 4*c* comprises a first end 5*c* and a second end 6*c*, the second end 6*c* being connected to another second disconnectable area 8. The second ball seat 7*b* is connected to the second disconnectable area 8. The intermediate annular barrier 4*c* is disconnectable from the second annular barrier by means of the other or second disconnectable area.

The plug and abandonment system 1 shown in FIGS. 2B-2K is arranged in the well, shown in FIG. 2A. The plug and abandonment system 1 comprises a first annular barrier 4*a* having a first end 5*a* comprising a first ball seat 7*a*. The plug and abandonment system 1 further comprises a second annular barrier 4*b* having a first end 5*b* comprising a second ball seat 7*b*. The plug and abandonment system 1 further comprises an intermediate annular barrier 4*c* arranged in between the first annular barrier 4*a* and the second annular barrier 4*b*, and the first end 5*c* of the intermediate annular barrier comprises a third ball seat 7*c*. The plug and abandonment system 1 further comprises a work string 10, such as drill pipe, wireline tool or coiled tubing, extending from a first string end 16 to the top of the well. The first string end 16 is disconnectably connected with the second end 6*b* of the second annular barrier 4*b*. The second end 6*a* of the first annular barrier is connected with a first disconnectable area 8*a* in order to be able to disconnect the first annular barrier from the intermediate annular barrier 4*c* and thus from the work string. The first end 5*c* having the third ball seat 7*c* of the intermediate annular barrier is also connected to the first disconnectable area 8*a* so that the connection between the first end 5*c* of the intermediate annular barrier and the second end 6*a* of the first annular barrier 4*a* form first disconnectable area 8*a*. The second end 6*c* of the intermediate annular barrier is connected to another (second) disconnectable area 8 so that the connection between the second end 6*c* of the intermediate annular barrier 4*c* and the first end 5*b* of the second annular barrier 4*b* form another disconnectable area 8. The third ball seat 7*c* has a third inner diameter ID3 being larger than a first inner diameter ID1 of the first ball seat and being smaller than a second inner diameter ID2 of the second ball seat so that the first ball designed to seat in the first ball seat 7*a* can pass the second and third ball seats, as shown in FIG. 2C, and the third ball designed to seat in the third ball seat 7*c* can pass the second ball seat 7*b*, as shown in FIG. 2F.

In order to expand the first annular barrier before the second annular barrier and the intermediate annular barrier, the first annular barrier comprises a first pressure-intensifying unit 20 fluidly connected with the tubular bore through an expansion opening 11 in the tubular part 14, as shown in FIG. 3, in order to intensify the pressure of the fluid flowing in through the expansion opening 11 from the tubular bore 15 before the fluid enters the expandable space 18.

By being able to expand the first annular barrier before the second annular barrier and by being able to disconnect the lowest annular barrier from the next annular barrier, a plug and abandonment system is provided that can be run in one run, i.e. where the work string does not have to be pulled out of the well and thus the plug and abandonment system provides a safer and quicker way of plugging and abandoning the well. Thus, the plug and abandonment system is less complex and less costly than known solutions as it requires only one run and has a simple design.

When the plug and abandonment system also comprises an intermediate annular barrier as shown in FIGS. 2B-2K, the intermediate annular barrier 4*c* comprises a second pressure intensifying unit 20*b*. The first pressure intensifying unit 20 is configured to pressure intensify the fluid flowing in the tubular bore and into the expansion opening with a predetermined pressure-intensifying factor being larger than that of the second pressure-intensifying unit 20*b* so that the first annular barrier 4*a* is expanded before the intermediate annular barrier 4*c* and the second annular barrier, and the intermediate annular barrier 4*c* is expanded before the second annular barrier since the second annular barrier does not have a pressure-intensifying unit and then the pressure in the tubular bore 15 has to be increased even further than compared to the pressure able to expand the intermediate annular barrier through the second pressure-intensifying unit 20*b*.

All the annular barriers of the plug and abandonment system 1 shown in FIG. 2B is firstly mounted to the work string and then run in hole by the work string 10 in their unexpanded condition until the first and lowest annular barrier 4*a* is arranged below the production zone, and the first ball is pumped down the plug and abandonment system 1 with the fluid until the first ball seats in the ball seat of the first annular barrier, as shown in FIG. 2C, and the expandable metal sleeve 9 of the first annular barrier 4*a* is expanded by building up pressure above the first ball 36*a* to a first predetermined pressure level. The fluid in the tubular bore 15 enters the expansion opening 11 of the first annular barrier 4*a* and then the fluid enters the first pressure-intensifying unit 20 and the fluid pressure is increased in the first pressure-intensifying unit 20 before the fluid enters the expandable space 18. After the expandable metal sleeve 9 of the first annular barrier 4*a* has been fully expanded to abut the inner face of the production casing 55, then the first annular barrier is disconnected from the intermediate annular barrier at the first disconnectable area 8*a*, and the work string 10 is pulled upwards towards the top 3, as shown in FIG. 2D, until arranged above the production casing 55. During this pulling upwards, cement is pumped down the plug and abandonment system 1, cementing above the first annular barrier to a level above the production zone, as shown in FIG. 2E. The cementing may be performed after the pulling of the work string upwards. After providing a cement plug of approximately 50-100 meters above the first annular barrier, then a third ball 36*c* for seating in the third ball seat 7*c* is dropped into the fluid and pumped down the work string until the third ball 36*c* seats in the ball seat 7*c* of the intermediate annular barrier 4*c*, as shown in FIG. 2F, and the pressure is increased in the tubular bore until reaching a third predetermined pressure level which is higher than the first predetermined pressure level and the expandable metal sleeve 9 of the intermediate annular barrier 4*c* is expanded. Then as shown in FIG. 2G, the second annular barrier 4*b* is disconnected from the intermediate annular barrier 4*c* and is pulled upwards. Subsequently, cement is pumped down the work string for providing a cement plug of approximately 50-100 meters above the second annular barrier 4*b*, as shown in FIG. 2H. Subsequently, a second ball 36*b* is dropped down the work string 10 for seating in the second ball seat 7*b* and pressurising the second annular barrier from within to expand the expandable metal sleeve 9 of the second annular barrier 4*b*, as shown in FIG. 2I. The work string is then disconnected and pulled upwards, as shown in FIG. 2J, and cement is pumped down the work string providing cement above the second annular barrier 4*b* providing a third cement plug, as shown in FIG. 2K and the work string is pulled out of the well.

The cement may be replaced by bismuth, a polymer or a thermite so that pumping cement is replaced by pumping the bismuth, the polymer or the thermite down the tubular bore, and then solidifying the bismuth, the polymer or the thermite above the first annular barrier to a level above the production zone.

The work string may be a wireline tool having a pump able to first drop a first ball from the wireline tool into the second end 6*b* of the second annular barrier and subsequently pumping fluid by means of the pump down the second annular barrier, until the first ball seats in the ball seat of the first annular barrier. After the step of disconnecting the first disconnectable area, pulling the wireline tool upwards towards the top of the well may be continued by pulling the wireline tool out of the well and a bailer section carrying the cement, bismuth, a polymer or a thermite is mounted as part of the wireline tool. Before the step of dropping a second ball, the wireline tool may be pulled out of the well, the bailer section being dismounted from the wireline tool and a tool section entailing the second ball being mounted as part of the wireline tool. After the step of disconnecting the second annular barrier from the wireline tool, the step of pulling the wireline tool upwards towards the top of the well may be continued by pulling the wireline tool out of the well, the bailer section carrying the cement, bismuth, a polymer or a thermite being mounted as part of the wireline tool. Thus, the same plug and abandonment system is provided, and the operation is performed in several runs by means of a wireline tool. If possible due to rig height, the wireline tool may be able to perform the operation in one run.

The first disconnectable connection 8*a* is disconnectable by turning the work string at surface in a first direction. The disconnectable connection between the intermediate annular barrier and the second annular barrier may disconnect by turning in a direction opposite the first direction. The first second disconnectable connection and the disconnectable connection between the intermediate annular barrier and the second annular barrier may disconnect by breaking a shear pin, e.g. by an axial force along the extension of the work string, e.g. a strong quick pull in the work string. In another embodiment, the first disconnectable connection 8*a* is disconnectable by turning part of the wireline tool in relation to another part of the wireline tool down in the well in a first direction.

FIG. 4 shows the pressure-intensifying unit 20, 20*b*, shown in FIGS. 2B-2K, having a first bore 21 and a piston unit 22. The first bore has a first bore part 23 with a first inner diameter $ID_1$ and a second bore part 24 with a second inner diameter $ID_2$. The piston unit has a first piston 25 with a first outer diameter $OD_1$ corresponding to the first inner diameter and a second piston 26 with a second outer diameter $OD_2$ corresponding to the second inner diameter. The second piston is connected to the first piston by means of a connecting rod 27, and the connecting rod 27 has a smaller outer diameter than the second piston. The first outer diameter is smaller than the second outer diameter. The first bore part has a first opening 31 in fluid communication with the expansion opening through a first fluid channel 41, and a first non-return valve 28 is arranged in the first fluid channel allowing fluid to enter the first opening. The first bore has a second opening 32 fluidly connected with a part of the first fluid channel upstream of the first non-return valve. The first bore part has a third opening 33 in fluid communication with the expandable space through a second non-return valve 29. The second bore part has a fourth opening 34 for entry of fluid in order to allow the first piston to move in a first direction, ejecting fluid through the third opening and into the expandable space, and for exit of fluid in order to allow the first piston to move in a second direction opposite the first direction. The second bore part has a fifth opening 35 in fluid communication with the fourth opening through a second fluid channel 42, and a sequence piston 30 surrounds the connecting rod and has a first sequence position in which the sequence piston prevents fluid communication between the second opening and the fifth opening and a second sequence position in which the sequence piston allows fluid communication between the second opening and the fifth opening in order to move the piston unit in the first direction.

In order to increase the fluid pressure of the fluid entering the expansion opening 11 before being ejected into the expandable space, the second outer diameter is more than 1.2 times larger than the first outer diameter, preferably more than 1.5 times larger than the first outer diameter, more preferably more than 2 times larger than the first outer diameter, and even more preferably more than 2.5 times larger than the first outer diameter.

The pressure intensification factor of the pressure-intensifying unit 20, 20*b* is given by the piston area difference between the first and the second piston and thus the difference between the second outer diameter and the first outer diameter $(OD_2/OD_1)^2$.

In FIG. 4, the pressure-intensifying unit 20 further comprises a second bore 151 having a first aperture 152 fluidly connected with the expansion opening 11 and a second aperture 53 fluidly connected with the first fluid channel 41. In the second bore, a third piston 154 and a fourth piston 155 connected by means of a second connecting rod 156 are arranged. In a deployment position of the annular barrier, i.e. when the annular barrier is run in the hole, the third piston and the fourth piston are arranged on either side of the second aperture 53, preventing fluid from entering the first fluid channel 41 and thus the expandable space 18. In this way, the expandable metal sleeve of the annular barrier is not expanded prematurely, and the annular barrier is not set in an unintended position preventing further movement of the system down the well. The second bore 151 is arranged in parallel to the first bore 21 but could be arranged in any angle to the first bore.

The third piston 154 and the fourth piston 155 are prevented from moving in the deployment position by a shear pin 59 until the expansion operation starts and a pressure builds up inside the tubular part; when a predetermined pressure is obtained in the tubular bore acting on the third piston 154, the shear pin is sheared, and the third piston and the fourth piston move, providing fluid communication between the first aperture 152 and the second aperture 53 and fluid communication to the first bore 21.

In order to prevent the expandable metal sleeve 9 from being pressed inwards due to a higher pressure down the well than in the expandable space 18 as the annular barrier is deployed, the second bore 151 further comprises a third aperture 157 in fluid communication with the production zone 101 and a fourth aperture 58 in fluid communication with the expandable space. In the deployment position, the third piston 154 and the fourth piston 155 are both arranged on one side of the third aperture 157 and the fourth aperture 58, providing fluid communication between the third and fourth apertures. Thus, the role of the third piston 154 and the fourth piston 155 is also to ensure that there is no trapped pressure in the annular barrier, i.e. in the expandable space 18, during deployment due to the non-return valve 29. The expandable space 18 underneath the expandable metal sleeve would therefore be pressure-compensated with the surrounding pressure. Thus, the third aperture 157 and the fourth aperture 58 are in fluid communication on the "back" side of the third piston 154 and the fourth piston 155 as the second aperture 53 is arranged on the "front" side of the third piston 154 and the fourth piston 155, while the third piston 154 and the fourth piston 155 are arranged on either side of the second aperture.

In FIG. 4, the pressure-intensifying unit 20 further comprises a first chamber 61 having a first chamber opening 68 fluidly connected to the second bore part 24 for accumulating fluid from the second bore part. Thus, the first chamber is a kind of accumulating chamber or accumulator. The first chamber has a second chamber opening 69 fluidly connected with the first fluid channel 41, and the first chamber comprises a first chamber piston 62 being spring-loaded by means of a spring 63 so that the first chamber piston is forced towards the first chamber opening 68. The first chamber piston is allowed to move between the first chamber opening 68 and the second chamber opening 69. By having a first chamber 61 with a spring-loaded first chamber piston 62, the first chamber is able to accumulate fluid in the second bore part 24 which cannot bypass the second piston 26 in the second fluid channel 42 when the second piston 26 moves in the second direction. This is primarily the situation which may occur towards the end of the movement in the second direction, where the first piston 25 moves the sequence piston 30, blocking the fifth opening 35 even though the second piston has not moved entirely to the end, and the remaining fluid can then enter the first chamber. In this way, no fluid/liquid is trapped preventing the second piston from moving to the end, and the first piston is not prevented from moving the sequence piston to the second sequence position opening for fluid passage to push the piston unit 22 in the first direction. The first chamber is thus a safety precaution to ensure that the sequence piston is able to move to the second sequence position. The first chamber piston is preloaded by the pressure in the expansion fluid pressing through the second chamber opening 69 and on the first chamber piston.

The pressure-intensifying unit 20 further comprises a second chamber 64 fluidly connected to the second bore part 24 via the first chamber 61. The second chamber comprises a third chamber opening 70 in fluid communication with the first chamber. The second chamber comprises a fourth chamber opening 67 fluidly connected with the production zone 101, and the second chamber comprises a second chamber piston 65 being spring-loaded by means of a spring 66, so that the second chamber piston is forced towards the fluid connection to the second bore part, i.e. towards the first chamber opening 68, and forced to move between the third chamber opening 70 and the fourth chamber opening 67. By having a second chamber 64 with a spring-loaded second chamber piston 65, the second chamber is able to provide pressurised fluid in the second bore part 24 to press the piston unit fully to the second non-return valve 29 and push the sequence piston 30 to the first sequence position. The second chamber piston 65 experiences surrounding pressure from the fourth chamber opening 67 and expansion pressure from the tubular metal part 7 through the expansion opening 11 and through the third chamber opening 70, and when the sequence piston is opposite the fifth opening 35, the fluid may be prevented from entering the second fluid channel 42 and from pressing on the second piston to move the piston unit further towards the second non-return valve. The sequence piston 30 may then not be fully moved to the first sequence position, and then the pressure difference across the second chamber piston will force the second chamber piston to move, increasing the pressure in the second bore part 24 in fluid communication with the second chamber through the first chamber opening. In this way, the movement of the sequence piston is completed, i.e. the first sequence position is ensured so that the movement cycle of the pressure-intensifying unit is completed.

In order to expand the expandable metal sleeve 9 of the annular barrier, the piston unit 22 and thus the first piston 25 and the second piston 26 have to move back and forth 500-5000 times, and the seals of these pistons are therefore preferably metal seals, ceramic seals or similar seals able to withstand such load.

In FIG. 6, the tubular part 14 has a first expansion opening 11 for allowing fluid to flow from the tubular bore to the first annular barrier 4*a* and a first shear disc 38 arranged in the first expansion opening. The tubular part of the second annular barrier has a second expansion opening (not shown) for allowing fluid to flow from the tubular bore to the second annular barrier and a second shear disc (not shown) is arranged in the second opening, the first shear disc is configured to break before the second shear disc so as to ensure that the first annular barrier is expanded before the second annular barrier.

The first annular barrier comprises a valve unit 120, as shown in FIG. 5, fluidly connected with the tubular bore, the valve unit having a piston 121 movable in a bore 119 being prevented from moving by a first shear pin 122. The valve unit 120 has a valve aperture 123 in fluid connection with the expandable space via a fluid channel 124. The valve unit is shown in its initial position where the valve aperture 123 is fluidly disconnected from the expansion opening 11. When the shear pin 122 has broken, the piston moves, the valve aperture 123 becomes fluidly connected to the expansion opening 11 and fluid is allowed to enter the expandable space to expand the expandable metal sleeve 9.

The intermediate annular barrier may also comprise a valve unit 120 having a piston movable in a bore being prevented from moving by a second shear pin, and the first shear pin is then configured to shear at a lower force than that of the second shear pin, so that the first annular barrier is expanded before the intermediate annular barrier.

The plug and abandonment system may comprise several intermediate annular barriers in between the first annular barrier and the second annular barrier. The intermediate annular barrier closest to the first annular barrier is configured to expand before the second intermediate annular barrier and so forth. The way of ensuring that the lowest annular barrier is expanded before the next adjacent annular barrier may be performed by any of the aforementioned, i.e. by using pressure intensifying units with different pressure-intensifying factors, valve units with different shear pins, shear discs shearing a different pressure, different thickness of the expandable metal sleeves, or expandable metal sleeves having different materials.

As shown in FIGS. 2B-2K, the plug and abandonment system further comprises an annular brush 37 connected with the first end 5*a* of the first annular barrier. The annular brush 37 comprises a brush body 37*a* and surrounding brush arms 37*b* which are flexible and slide along the inner face of the well tubular metal structure 55. The work string 10 is disconnectably connected with the second annular barrier by means of a running tool 39 (shown in FIG. 1).

The plug and abandonment method for providing a safe plug and abandonment of a well 2 by means of the plug and abandonment system mentioned above comprises mounting of a first and second annular barriers 4*a*, 4*b* to a work string 10, submerging the plug and abandonment system into the well, so that the first annular barrier is below the production zone, dropping a first ball into the work string, then pumping of fluid down the work string until the first ball seats in the ball seat of the first annular barrier, and then pressurising the work string and the tubular bore until a first predetermined pressure level expanding the expandable metal sleeve of the first annular barrier. Then, the plug and abandonment method comprises disconnecting the first disconnectable area in order to disconnect the first annular barrier, pulling the work string upwards towards the top of the well and pumping cement down the work string in order to cement above the first annular barrier to a level above the production zone. Subsequently, the plug and abandonment method comprises dropping a second ball into the work string, pumping of fluid down the work string until the second ball seats in the ball seat of the second annular barrier, and pressurising the work string and the tubular bore until a second predetermined pressure level which is higher than the first predetermined pressure level to expand the expandable metal sleeve of the second annular barrier, and then disconnecting the second annular barrier from the work string. Subsequently, the method comprises pulling the work string upwards towards the top of the well and pumping cement down the work string, cementing above the second annular barrier, and finally the work string is pulled out of the well.

When the plug and abandonment system further comprises an intermediate annular barrier 4*c* arranged in between the first annular barrier 4*a* and the second annular barrier 4*b*, then mounting of a first and second annular barriers 4*a*, 4*b* to a work string 10 comprises mounting of the intermediate annular barrier 4*c* in between the first annular barrier 4*a* and the second annular barrier 4*b*, so that the second end 6*a* of the first annular barrier is connected with the first end 5*c* of the intermediate annular barrier, and the second end 6*c* of the intermediate annular 4*c* barrier is connected with the first end 6*b* of the second annular barrier 4*b*. Before dropping a second ball into the work string, the plug and abandonment method comprises dropping a third ball into the work string, pumping of fluid down the work string until the third ball seats in the ball seat of the intermediate annular barrier, pressurising the work string and the tubular bore until a third predetermined pressure level which is higher than the first predetermined pressure level and lower than a second predetermined pressure level, expanding the expandable metal sleeve of the intermediate annular barrier. Then, the intermediate annular barrier is disconnected from the work string, the work string is pulled upwards towards the top of the well and pumping cement down the work string, cementing above the intermediate annular barrier.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

In the event that the work string is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A plug and abandonment system for plugging and abandoning a well having a top, comprising:

a first annular barrier having a first end and a second end, the first end comprising a first ball seat and the second end being connected with a first disconnectable area, a second annular barrier having a first end and a second end, the first end comprising a second ball seat and being connected with the first disconnectable area, and a work string extending from a first string end to the top of the well, the first string end being disconnectably connected with the second end of the second annular barrier, wherein the first annual barrier has a first expansion pressure level to expand the first annular barrier, and the second annual barrier has a second expansion pressure level to expand the second annular barrier, where the first expansion pressure level is lower than the second expansion pressure level, wherein each of the annular barriers comprises an expandable metal sleeve being connected to at least one tubular part forming a tubular bore for allowing liquid and cement to flow through the annular barriers, wherein the first disconnectable area is a disconnectable area that is configured to be disconnected inside the well, wherein the work string is configured to be disconnectably connected downhole to the second end of the second annular barrier, and wherein the work string is configured to be disconnected while inside the well to the second end of the second annular barrier, and wherein the first annular barrier is configured to be expanded prior to the disconnection of the first annular barrier from the work string, and the second annular barrier is configured to be expanded after the disconnection of the first annual barrier from the work string.

2. The plug and abandonment system according to claim 1, wherein the first annular barrier is disconnectable from the second annular barrier via the first disconnectable area.

3. The plug and abandonment system according to claim 1, wherein each annular barrier comprises the tubular part and the expandable metal sleeve surrounding the tubular part, each end of the expandable metal sleeve being connected with an outer face of the tubular part providing an expandable space therebetween.

4. The plug and abandonment system according to claim 3, wherein the first annular barrier comprises a first pressure-intensifying unit fluidly connected with the tubular bore through an expansion opening in the tubular part in order to intensify a pressure of a fluid flowing in through the expansion opening from the tubular bore before the fluid enters the expandable space.

5. The plug and abandonment system according to claim 4, further comprising an intermediate annular barrier arranged in between the first annular barrier and the second annular barrier, a first end of the intermediate annular barrier comprising a third ball seat.

6. The plug and abandonment system according to claim 5, wherein the third ball seat has a third inner diameter being larger than a first inner diameter of the first ball seat and being smaller than a second inner diameter of the second ball seat.

7. The plug and abandonment system according to claim 5, wherein the intermediate annular barrier comprises a second pressure-intensifying unit, the first pressure-intensifying unit being configured to pressure intensify the fluid flowing in the tubular bore with a predetermined pressure-intensifying factor being larger than that of the second pressure-intensifying unit.

8. The plug and abandonment system according to claim 7, wherein the expandable metal sleeve of the first annular barrier has a first thickness being smaller than a second thickness of the expandable metal sleeve of the second annular barrier, so that the expandable metal sleeve of the first annular barrier is configured to expand at a lower pressure in the tubular bore than the expandable metal sleeve of the second annular barrier.

9. The plug and abandonment system according to claim 7, wherein the expandable metal sleeve of the first annular barrier is made of a first material, the expandable metal sleeve of the second annular barrier being made of a second material, the first material demanding lower pressure in order to expand than the second material so that the expandable metal sleeve of the first annular barrier is configured to expand at a lower pressure in the tubular bore than the expandable metal sleeve of the second annular barrier.

10. The plug and abandonment system according to claim 1, wherein the first annular barrier comprises a valve unit fluidly connected with the tubular bore, the valve unit having a piston movable in a bore and prevented from moving by a first shear pin.

11. The plug and abandonment system according to claim 1, wherein each of the first and the second annular barrier comprise the expandable metal sleeve and a first tubular part having a first tubular inner face and a second tubular part having a second tubular inner face, one end of the first tubular part being mounted end-to-end to a first sleeve end of the expandable metal sleeve and one end of the second tubular part being mounted end-to-end to a second sleeve end of the expandable metal sleeve so that at least the first tubular inner face and the second tubular inner face form the tubular bore.

12. The plug and abandonment system according to claim 1, wherein the system comprises several intermediate annular barriers in between the first annular barrier and the second annular barrier.

13. A plug and abandonment method for providing a safe plug and abandonment of a well having at least one production zone, comprising:

mounting of a first and second annular barriers to a work string of the plug and abandonment system according to claim 1, submerging the plug and abandonment system into the well so that the first annular barrier is below the production zone, dropping a first ball into the work string, pumping of fluid down the work string until the first ball seats in the first ball seat of the first annular barrier, pressurising the work string and the tubular bore until a first predetermined pressure level, expanding the expandable metal sleeve of the first annular barrier, disconnecting the first disconnectable area in order to disconnect first annular barrier while inside the well, pulling the work string upwards towards the top of the well, pumping cement down the work string, cementing above the first annular barrier to a level above the production zone, dropping a second ball into the work string, pumping of fluid down the work string until the second ball seats in the second ball seat of the second annular barrier, pressurising the work string and the tubular bore until the second predetermined pressure level which is higher than the first predetermined pressure level, expanding the expandable metal sleeve of the second annular barrier, disconnecting the second annular barrier from the work string while inside the well, pulling the work string upwards towards the top of the well, pumping cement down the work string, cementing above the second annular barrier, and pulling the work string out of the well.

14. The plug and abandonment method according to claim 13, wherein the plug and abandonment system further comprises an intermediate annular barrier arranged in between the first annular barrier and the second annular barrier, the first end of the intermediate annular barrier comprising a third ball seat.

15. The plug and abandonment method according to claim 14, wherein mounting of a first and a second annular barrier to a work string comprises mounting of the intermediate annular barrier in between the first annular barrier and the second annular barrier, so that the second end of the first annular barrier is connected with the first end of the intermediate annular barrier, and the second end of the intermediate annular barrier is connected with the first end of the second annular barrier.

16. The plug and abandonment method according to claim 14, wherein before dropping a second ball into the work string, the plug and abandonment method comprises the following:

dropping a third ball into the work string, pumping of fluid down the work string until the third ball seats in the ball seat of the intermediate annular barrier, pressurising the work string and the tubular bore until a third predetermined pressure level which is higher than the first predetermined pressure level and lower than the second predetermined pressure level, expanding the expandable metal sleeve of the intermediate annular barrier, disconnecting the intermediate annular barrier from the work string, pulling the work string upwards towards the top of the well, pumping cement down the work string, and cementing above the intermediate annular barrier.

17. A plug and abandonment method for providing a safe plug and abandonment of a well having at least one production zone, comprising:

mounting of a first and second annular barriers to a work string of the plug and abandonment system according to claim 1, the work string being a wireline tool having a pump, submerging the plug and abandonment system into the well so that the first annular barrier is below the production zone, dropping a first ball from the wireline tool into the second end of the second annular barrier, pumping of fluid by means of the pump down the second annular barrier until the first ball seats in the first ball seat of the first annular barrier, pressurising the tubular bore until a first predetermined pressure level, expanding the expandable metal sleeve of the first annular barrier, disconnecting the first disconnectable area in order to disconnect the first annular barrier, pulling the wireline tool upwards towards the top of the well, pumping cement, bismuth, a polymer or a thermite down the tubular bore, solidifying the cement, bismuth, a polymer or a thermite above the first annular barrier to a level above the production zone, dropping a second ball from the wireline tool, pumping of fluid down the wireline tool until the second ball seats in the second ball seat of the second annular barrier, pressurising the second annular barrier until a second predetermined pressure level which is higher than the first predetermined pressure level, expanding the expandable metal sleeve of the second annular barrier, disconnecting the second annular barrier from the wireline tool, pulling the wireline tool upwards towards the top of the well, pumping cement, bismuth, a polymer or a thermite down the tubular bore, solidifying the cement, the bismuth, the polymer or the thermite above the second annular barrier, and pulling the wireline tool out of the well.

18. The plug and abandonment method according to claim 17, wherein after the step of disconnecting the first disconnectable area, pulling the wireline tool upwards towards the top of the well is continued by pulling the wireline tool out of the well, a bailer section carrying the cement, the bismuth, the polymer or the thermite being mounted as part of the wireline tool.

19. The plug and abandonment method according to claim 18, wherein before the step of dropping a second ball, the wireline tool is pulled out of the well, the bailer section is dismounted from the wireline tool, and a tool section entailing the second ball is mounted as part of the wireline tool.

20. The plug and abandonment method according to claim 18, wherein after the step of disconnecting the second annular barrier from the wireline tool, pulling the wireline tool upwards towards the top of the well is continued by pulling the wireline tool out of the well and the bailer section carrying the cement, the bismuth, the polymer or the thermite being mounted as part of the wireline tool.

21. The plug and abandonment system according to claim 1, wherein the first annular barrier is configured to expand when a first ball is arranged in the first ball seat, and the second annular barrier is configured to expand when a second ball is arranged in the second ball seat subsequent to the disconnect of the work string.

* * * * *